United States Patent [19]

Renk et al.

[11] 4,106,664

[45] Aug. 15, 1978

[54] CLOSURE

[75] Inventors: Richard John Renk; George Earl Boller, both of Winona, Minn.

[73] Assignee: Gladys D. Miller, Winona, Minn.

[21] Appl. No.: 693,091

[22] Filed: Jun. 4, 1976

[51] Int. Cl.[2] ..... B65D 43/14

[52] U.S. Cl. ..... 220/329; 220/375

[58] Field of Search ..... 220/329, 334, 375

[56] References Cited

U.S. PATENT DOCUMENTS

| | | | |
|---|---|---|---|
| 365,232 | 6/1887 | Bingham | 220/329 |
| 1,366,854 | 1/1921 | Warren | 220/375 |
| 1,589,771 | 6/1926 | Tucker | 220/375 |
| 2,062,218 | 11/1936 | Gielen | 220/375 |
| 2,491,070 | 12/1949 | Armstrong | 220/375 |
| 2,547,353 | 4/1951 | Wiinikka | 220/329 |
| 2,647,655 | 8/1953 | Robinson | 220/375 |
| 2,737,312 | 3/1956 | Hamlon | 220/375 |
| 3,044,106 | 7/1962 | Papsdorf | 220/329 |
| 3,462,034 | 8/1969 | Friedberg | 215/329 |

FOREIGN PATENT DOCUMENTS

| | | | |
|---|---|---|---|
| 1,253,868 | 1/1961 | France | 220/275 |
| 907,746 | 3/1954 | Fed. Rep. of Germany | 220/375 |
| 527,043 | 3/1955 | Italy | 215/329 |
| 411,579 | 6/1934 | United Kingdom | 220/375 |

*Primary Examiner*—Ro E. Hart

*Attorney, Agent, or Firm*—Richard J. Renk

[57] ABSTRACT

A closure with a self-closing top which may be substantially removed from contact with its associated base to provide a substantially unobstructed filling opening.

13 Claims, 5 Drawing Figures

CLOSURE

BACKGROUND OF INVENTION

It is generally desireable for liquid retaining reservoirs, such as used in conjunction with many bearings, to have a filler opening which can be easily opened for the addition of lubricant or other media.

In the past, closures which have been used to seal filler openings have been plagued with a series of problems. Many have been easily damaged. The so-called "self-closing" types have not provided good seals. The twist or screw type closures often times are left open because a worker forgets to re-apply the closure or the screw closures are cocked on re-application resulting in leakage.

SUMMARY OF INVENTION

The present invention overcomes the problems of the prior closures by providing a positive self-closing action with minimum obstruction to the filler opening when the closure is open. This is accomplished by providing a top to restrict an opening in a base member, securing means for attaching the top to the base, biasing means associated with the securing means to urge the top into engagement with the base, and guide means for keeping the securing means in a pre-determined location with respect to the base member.

PREFERRED EMBODIMENTS

Figure 1:
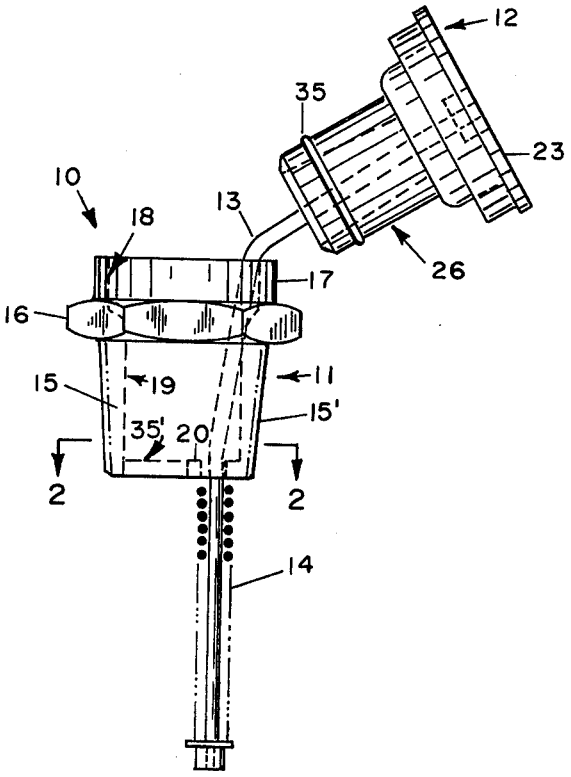
FIG. 1 is a side view depicting one form the closure may take showing it in the open position.
Figure 3:
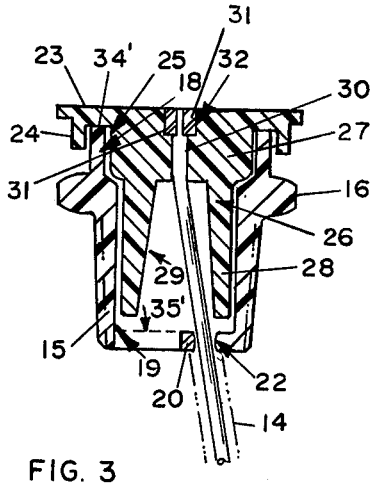
FIG. 3 is a vertical sectional view of the closure of FIG. 1 showing it in its closed position.
Figure 2:
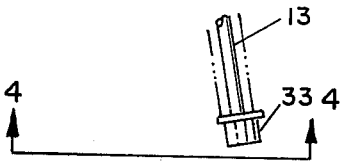
FIG. 2 is a sectional view taken along lines 2—2 of FIG. 1.
Figure 2:
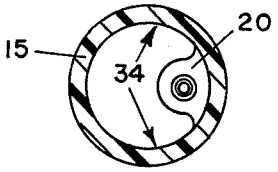

Reference is now made to the drawings wherein the closure of the invention is indicated generally by the numeral 10. As best seen in FIG. 1, the closure 10 may include a base 11, a top 12, a securing means such as a cable 13, and biasing means such as a spring 14 which urges the top into a closed position (such as FIG. 3).

The base 11 may be of a somewhat conventional configuration and include a lower wall 15 with a threaded area 15' (for attachment to a tank, etc.), a hex area 16 for wrench engagement and a rim area 17. The base 11 has an opening therein which may take different configurations, but, in the embodiment shown, has a step-bore with a wider upper cylindrical bore 18 and a narrower lower cylindrical bore 19.

To retain the cable 13 in position, the base 11 has guide means 20 which may extend as a tab at generally right angles from the lower end of wall 15 and inwardly toward the center of the bore 19. An opening such as a hole 22 is provided in the guide 20 through which the cable 13 passes.

Cable 13 is preferably of a pliant, continuous, smooth, flexible type, of uniform cross-sectional area, which is easily bendable and can somewhat conform to the sides of the base bores when the top is pulled out. One material which has been found to work exceptionally well is a one piece, multistrand flexible nylon coated aircraft cable.

The top 12 in the embodiment shown has a flat upper face plate 23, a depending annular flange 24 which extends downwardly on the outside of the rim 17 of the base 11, an annular groove 25 into which the base rim 17 extends, and a stem 26 depending from the under-side of the plate 23 and extending downwardly into the bore(s) of the base 11. Stem 26 provides an inside wall for the groove 25 and is generally complimentary to the bore contours in the base. As such, stem 26 includes a bulged area 27 to correspond to the cylindrical bore 18, and a lower shank portion 28 which corresponds to the lower cylindrical bore 19. The shank thus extends into the bore in the nature of a plug to provide a baffle against splashing.

The shank 28 has an internal recess 29 opening from the bottom of the stem an extending upwardly toward the face plate 23. This enables the cable 13 to extend upwardly into the top without touching the inside of the shank as defined by the wall of the recess 29 to keep from camming or urging the stem excessively to one side of the base bore(s).

For attachment of the top 12 to the base 11, the cable 13 extends through a hole 30 in the top. The cable is prevented from pulling through the top on its upper end by a clinch-nut or bushing 31 which nests in a counterbore 32 in the top. As it projects downwardly from the top, the cable passes through the guide 20 and thence through the inside bore of the biasing means 14 in the form of a compression spring. At its lower end the cable is held by another clinch-nut or bushing 33. The clinch-nut has a larger outside diameter than the bore of the spring 14 to prevent the cable from pullng therethrough.

At its top, spring 14 bears against the underside of the guide 20. Thus, as the top 12 is pulled upwardly (as in FIG. 1), the spring 14 is gradually compressed. When fully compressed, the spring bottoms out against the guide 20, the latter forming a stop or abutment to limit travel of the spring and top. Means are thus provided to prevent over-extension of the spring so as not to stretch the spring beyond its limit and thereby make it inoperative.

As a feature of the embodiment of FIGS. 1–5, guide 20 is off-set to the side of the bore 19 and provides a substantially unobstructed passage through the bore(s) (as outlined at 34 in FIG. 2) for filling or for insertion of a dip stick. At the same time, the relatively thin and pliant nature of the cable 13 provides very little restriction in the bore areas (18 and 19) as the cable is able to hug and somewhat conform to the side of the bore to make it easy to introduce a nozzle or dip stick thereinto. The spring 14 is also off-set and of relatively small diameter to provide minimum interference and restriction. In the embodiment shown, the spring is actually located outside of or beyond the bore(s) in the base.

Figure 4:
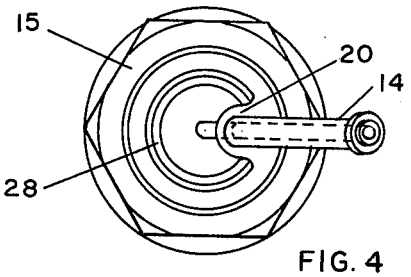
FIG. 4 is a bottom view of the closure taken along lines 4—4 of FIG. 3.

To provide for easy sliding movement of the cable 13 through the guide 20, the hole 22 therein may be slanted or at an angle to the plane of the guide to place it more in line with the angle of the cable in the closed position of FIG. 4. In other words, with the center line axis of the hole generally in line with the center axis of the cable. In the alternative, the guide 20 may be bent at an angle other than a right angle to the side wall 19 of the base.

In operation, after the top 12 has been pulled outwardly (FIG. 1), it snaps back when released under the action of spring 14 into restrictive closing position with respect to the base 11 (FIG. 4). The shank 28 acts as a pilot as it enters the bores 18 and 19 to guide the cap into the proper position. In addition, the shank acts to further restrict and baffle leakage through the top. Likewise, the top's bulged area 27 provides further restriction to leakage as does the rim 17 of the base 11 which seats against the top 34' of the annular groove 25.

As shown in FIG. 1, sealing means, such as an "O" ring 35, may be used on the outer diameter of the shank 28 to provide further sealing against the bore 19. Of course, a sealing ring can also be used around the bulged area 27.

Figure 5:
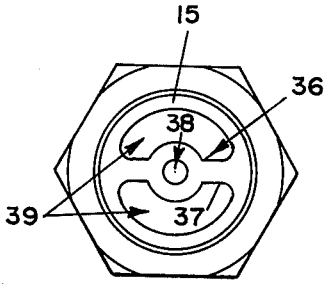
FIG. 5 is a bottom view of the base of the closure showing another embodiment.

Another embodiment of the cable guide is shown in FIG. 5 which differs by having the guide indicated at 36 centered with respect to the bore. In such case, a web 37 extends from the wall 15 of the base to form a support for a guide hole 38. Openings 39 on both sides of the web provide passage-ways through the base.

While the spring guide has been shown to be an integral part of the base, it can of course be a separate piece. Likewise, while the base has been shown to be threaded, it could take the form of a plain pipe or tubing to be welded to a container, etc., or it could be part of the container itself. The top of course can take on other shapes and can be in the form of a plug, etc.

Another unique feature of the closure is that the guide means 20 can be formed integrally with the base 11 as a continuation of the same material. One means of forming the guide on the base is to machine, such as by drilling or boring, the base downwardly from the rim area 17 but stop short of drilling or boring through the length of the base as shown by the dotted line at 35'. That is, machining is stopped a distance equivalent to the thickness of the guide 20 and the base is closed at the bottom. The opening contour is indicated at 34 (FIG. 2) is then formed by punching out the bottom of the base leaving the guide 20 profile remaining. The guide is thus an integral part of the base with the same grain structure orientation and does not require a separate piece to be welded or attached in some other manner. Likewise, the guide is not formed by bending which could introduce stresses and possible cracking.

What we claim is:

1. A closure for use with a base member having a bore therein defined by a wall area comprising, a top member adapted to be moved into and out of engagement with said base member, securing means having a relatively smooth area operatively connecting said top member to said base member, said securing means being pliant so as to be able to somewhat conform to said bore, guide means carried by one of said members for slideably engaging said securing means along said smooth area and keeping at least a portion of the securing means in a pre-determined alignment with respect to its associated member while allowing other portions of said securing means to be moved toward a different area of said base member to provide a relatively unobstructed bore, and biasing means operatively connected to said securing means to urge said top member into restrictive engagement with said base member, said top member being capable of being moved away from said base member to provide a generally unobstructed filling opening and being moveable into engagement with said base member under the action of said biasing means which causes said securing means to slide past said guide means and urge said top member into engagement with said base member.

2. A closure as claimed in claim 1 wherein said guide means is off-set to one side of said bore and urges said pliant securing means toward a side thereof.

3. A closure as claimed in claim 1 wherein at least a substantial portion of said biasing means extends outwardly of said base to provide a minimum of restriction in said bore.

4. A closure as claimed in claim 1 wherein said biasing means is smaller than said bore and extends to the side of said base and is in general alignment with said guide means, with said guide means limiting travel thereof.

5. A closure as claimed in claim 1 wherein said guide means has an opening therein through which said pliant securing means passes.

6. A closure as claimed in claim 5 wherein the opening in said guide means is slanted to be somewhat in line with the center line axis of the securing means when the top is in its closed position.

7. A closure as claimed in claim 1 wherein said top member has a stem and said stem has sealing means for engaging an area of a wall of said base member.

8. A closure as claimed in claim 1 wherein said guide means is formed integrally with said base member and as a continuation of the same material.

9. A closure as claimed in claim 1 wherein said guide means includes a tab which extends from a wall of said base member inwardly toward the center of the bore in said base member and wherein said tab has an opening through which said pliant securing means passes.

10. A closure as claimed in claim 1 wherein said base member has a machined bore area up to said guide means and a punched out area surrounding said guide means.

11. A closure as claimed in claim 1 wherein said top member has a relatively long shank portion which extends downwardly into said bore in said base member, and wherein said shank portion has an internal recess extending upwardly from the bottom thereof defined by a wall of said shank, and wherein said securing means extends into said recess in connecting to said top member.

12. A closure for use in combination with a supporting base having a bore therein defined by a wall area comprising, a top adapted to be moved into and out of engagement with said base, a stationary guide means carried by said base and extending inwardly from said wall, said guide means having an opening therein offset toward a side of said bore, a relatively smooth pliant securing means extending into said bore of said base operatively connected to said top and to said base, said securing means being able to somewhat conform to the bore of said base and extending in said opening of said guide means and being moveable relative thereto, said guide means keeping said securing means therein in fixed pre-determined alignment relative to said base as it extends in the opening in said guide means, spring means offset with respect to said bore and extending around a portion of said securing means and being operatively connected thereto, said spring means along another portion thereof being limited in its movement by said guide means with at least a portion of said spring means being located outside of the bore and base to provide a minimum of restriction in said bore, said guide means being positioned between said top and said spring means, said top when pulled out of engagement with said base acting to pull said securing means relative to said guide means and through said bore with movement of said top being limited by said securing means causing said spring means travel to be limited by said guide means, said pliant securing means being able to be moved toward and into contact with the wall of said bore to enable said top to be moved away from said base and provide a relatively unobstructed opening in said bore, said spring means upon release of said top being operative to pull said securing means past said guide means and thereby cause said top to move toward engagement with said base.

13. A closure for use in combination with a base member having a bore defined by a wall comprising, a top member moveable into and out of engagement with said base member to restrict said bore, securing means operably connecting said top member to said base member, said securing means having a generally uniform cross-sectional area and having a generally smooth and pliant section which is easily bendable so as to enable it to somewhat conform to the bore of said base member, spring means operatively connected between said securing means and said base member for urging said top member into restrictive engagement with said base member through said securing means, abutment means carried by one of said members for restraining said spring means along a portion thereof to provide a stop therefor and to retain a portion of said spring in a generally fixed position relative to its associated member, said pliant securing means being relatively thin and permitting said top member to be pulled completely out of engagement with said base member and thence allowing said top member to be pulled to the side away from said base member to enable a portion of said securing means to be moved against a portion of the bore of said base member to provide a substantially unobstructed passage through said bore.

* * * * *